United States Patent [19]

Murrell

[11] Patent Number: 4,632,220

[45] Date of Patent: Dec. 30, 1986

[54] SAFETY LADDER

[76] Inventor: John E. Murrell, 32 Wakehurst Parkway, Seaforth, N.S.W. 2092, Australia

[21] Appl. No.: 787,360

[22] Filed: Oct. 15, 1985

[51] Int. Cl.[4] ..... E06C 7/42; E06C 1/16

[52] U.S. Cl. ..... 182/111; 182/170; 182/172

[58] Field of Search ..... 182/107, 108, 204, 172, 182/111, 201, 170

[56] References Cited

U.S. PATENT DOCUMENTS

| | | | |
|---|---|---|---|
| 1,151,809 | 8/1915 | Morgan | 182/172 |
| 1,496,201 | 6/1924 | Baxter | 182/172 |
| 2,574,286 | 11/1951 | Rein | 182/111 |
| 3,025,926 | 3/1962 | Vives | 182/111 |
| 3,269,486 | 8/1966 | Machen | 182/170 |
| 4,147,231 | 4/1979 | Chantler | 182/172 |
| 4,519,477 | 5/1985 | Ralston | 182/172 |

*Primary Examiner*—Reinaldo P. Machado

*Attorney, Agent, or Firm*—McDermott, Will & Emery

[57] ABSTRACT

Ladder to the lower section of which are fitted two outriggers extending outwardly and forwardly for the purpose of enhancing the safety of the ladder in use. Each outrigger has a foot and is capable of being folded up against and parallel to the stile to which it is fitted for storage or transportation. The outriggers are lockable in any desired position by a cam and friction plate mechanism. Preferably each stile is provided with an adjustable extension leg controlled by a ratchet and panel arrangement to facilitate use of the ladder on uneven ground.

4 Claims, 6 Drawing Figures

SAFETY LADDER

This invention relates to safety ladders and in one embodiment relates to a safety extension ladder.

A major cause of industrial accidents is the improper use of ladders, particularly extension ladders. Such ladders are often fully extended on the exterior of buildings in conditions that are hazardous to the user. Such conditions can include an uneven or soft base, wind, and lack of frictional contact between the top of the ladder and its supportive surface. Further, once the user has left the top of the ladder, for example on the roof of a two storey building, it is not uncommon for the ladder to be subject to severe wind and be blown away. In this situation, a second operator is required to hold the ladder in the desired position.

It is an object of this invention to provide a ladder which provides a secure base for ascents without the necessity of a second operator. Another object of the present invention is to provide a kit which may be applied to known extension ladders to cause them to be more secure and therefore safer.

A further object of the present invention include the provision of a safety ladder which does not require special footings. Yet a further object is to provide a safety ladder which, when the outriggers are retracted, can be transported or stored in a similar fashion to a mormal ladder without requiring any specialised facilities, having inhibiting protrusions, or being inconveniently heavy or awkward to handle.

In accordance with the present invention therefore there is provided a safety ladder having two stiles and numerous rungs therebetween, characterised in that each of said stiles is provided with an outrigger adapted to project sidewardly from said ladder, said outriggers being hingedly secured at the inner lower ends thereof to said stiles and being slideably secured to said stiles at the upper inner ends thereof, the outer ends of said outriggers being provided with means to stabilise said ladder when in use. Preferably the invention provides a safety extension ladder, in which the lower portion of each of said stiles is provided with an axially extendable leg.

One embodiment of my invention will now be described with reference to the accompanying drawings, in which.

Figure 5:
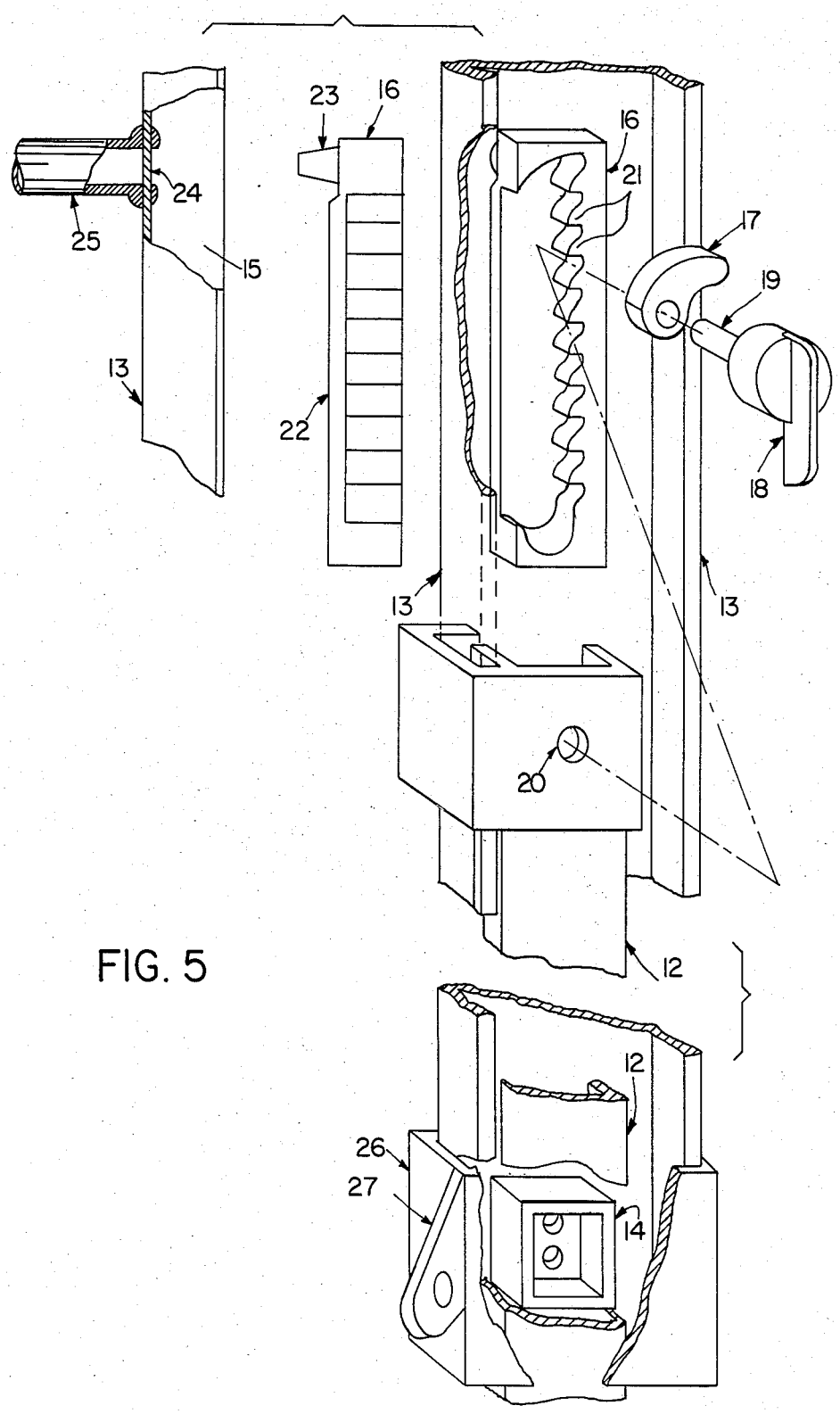
FIG. 5 illustrates the method of adjustment of the extendable feet and the method of attachment of the ratchet to the stile and rung.

In the preferred embodiment illustrated, and which relates exclusively to aluminium ladders, the ladder includes a top extension ladder 10 slideably secured to a lower portion 11 of an extension ladder in the normal way. The ladder is shown standing on a support surface 45 and resting against a wall 35. The ladder includes two adjustable extendable legs 12 of fixed length, each of which may be locked to the foot of the stile 13 to which it is fitted at any appropriate point. The method of locking the extendable leg 12 is shown in more detail in FIG. 5 wherein a guide block 14 is fixedly secured within the channel section 15 commonly found in aluminium ladder stiles. A ratchet rack means 16 is also rigidly affixed within the channel of the stile above the guide block 14. The extendable legs 12, which are of substantially U section as shown in FIG. 5, are provided with pivoting pawls 17 operable be release levers 18. The shaft 19 of each release lever shown in FIG. 5 is adapted to pass through a hole 20 provided in the upper end of each adjustable leg and fixedly engage the pawl 17.

If the pawl 17 is disengaged, the adjustable leg 12 may be moved longitudinally in relation to the stile 13 between the extremities provided within the ratchet rack 16. The leg may be locked in any desired position by engaging the pawl with a tooth 21 of the ratchet means 16. The guide block 14 prevents sidewards movement of the leg in relation to the stile.

Preferably, the rear face 22 of the ratchet rack 16 is provided with a peg 23 which snugly fits into the naked end 24 of a rung 25 of the ladder. The peg 23 locates said rack within the stile channel section 15 and is held to the stile with rivets.

Between the lower ends of the stile 13,13 is affixed a frame 26. To this frame, which includes fixed sleeves for locating the lower portions of the extendable legs 12,12, is hingedly affixed at 27 the inner lower ends 28 of outrigger spars 29, to the outer ends 30 of which is affixed outrigger feet 31 as shown in FIGS. 1, 2, 3, 4 and 6. Each foot 31 is also hingedly connected to the stile at 32 by means of an upper outrigger spar 33.

Figure 6:
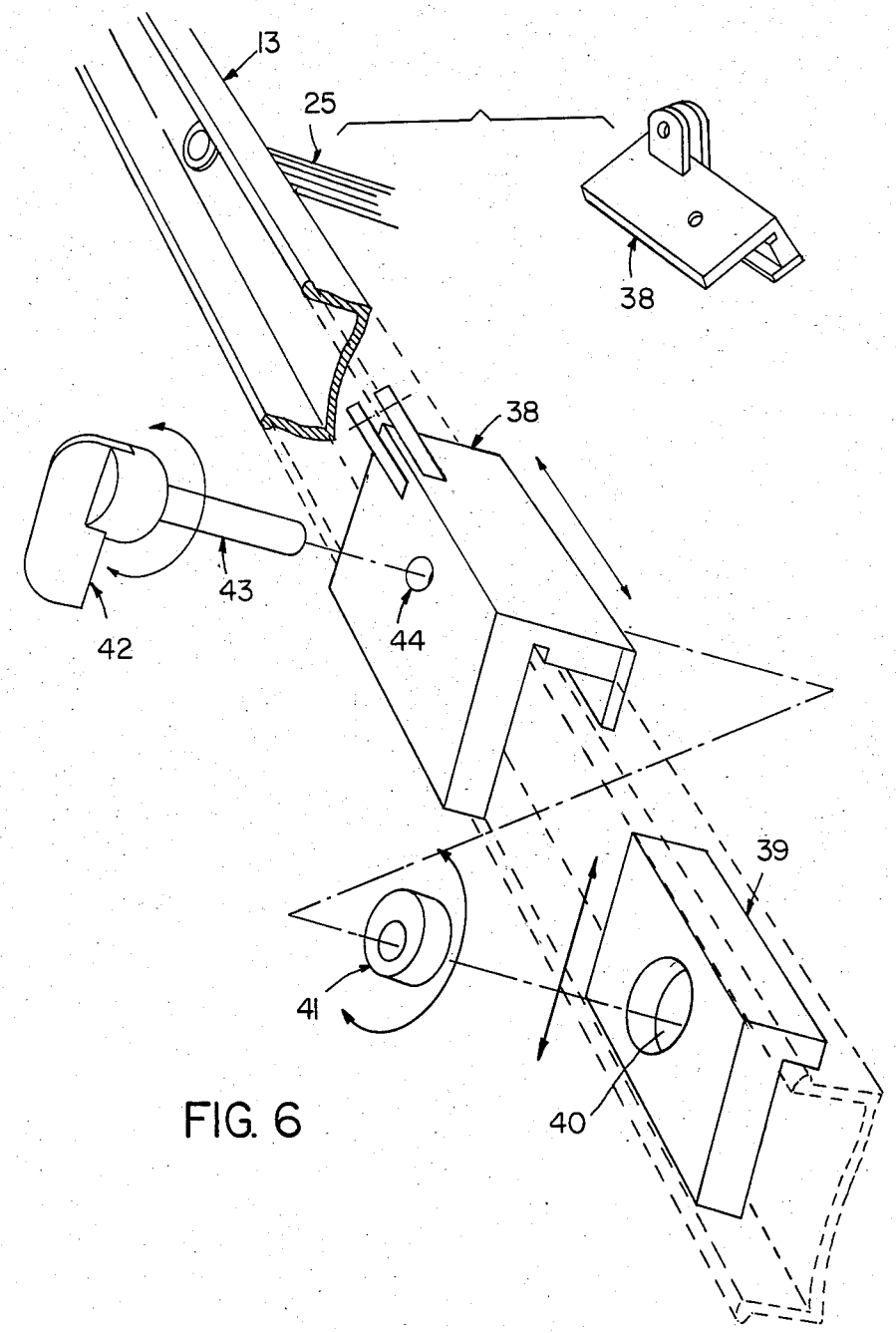
FIG. 6 illustrates the method of locking the upper inner end of the outrigger arms to the stiles.

The upper outrigger spar is slideably secured to the stile 13 by means of a cam and friction plate mechanism 34 shown in FIG. 6. This mechanism comprises an outer sleeve 38 adapted to be slideably secured to the stile 13. The stile 13 is also provided with an inner complimentary slidable sleeve or friction plate 39. The friction plate 39 has an oversize hole 40 through it and within which may rotate a cam 41 eccentrically mounted on the shaft 43 of an operating lever 42. Shaft 43 is mounted in a bearing hole 44 in the said outer sleeve 38. Operation of the lever 42 jams the inner and outer sleeves against the faces of one web of the stile, thus locking the mechanism to the stile and causing the outrigger to be locked in any desired position.

An adjustable outrigger stabilizer cable 37 is provided between the outer end 30 of the lower outrigger bar 29 and the fixed frame 26 by means of a pulley and a quick release jamming device 38. The safety cables 37 prevent uncontrolled movement of the outriggers away from the ladder The outrigger spars are affixed to the stiles such that they protrude outwardly from the sides of the ladder and preferably are confined in movement in a plane of about an angle of 45 towards the structure 35 supporting the ladder (see FIG. 2). Although the ladder does not require a support structure, it is preferable to lean it against such structure and then swing out the outriggers to provide the desired lateral stability. However, the ladder will be self supporting if the outriggers are extended prior to erection of the upper extension 10.

Both ladder stiles 13,13 may be extended, in the preferred embodiment, by up to 210 mm by means of the extendable legs 12 fitted to the feet thereof.

In a preferred embodiment, the ratchet mechanism 16 on one stile 13 is offset from the ratchet mechanism of the other stile by a distance being half the length of the base of a ratchet tooth. This provides a fine degree of adjustment where necessary.

All four feet of the safety ladder the subject of my invention may be provided with appropriate high friction materials 36 such as bonded neoprene.

The outriggers can each be adjusted independently of the stiles. Further, the outriggers can accommodate variations in the degree in whic the stiles may be themselves extended by means of the extendable legs and cable tensioners.

Figure 1:
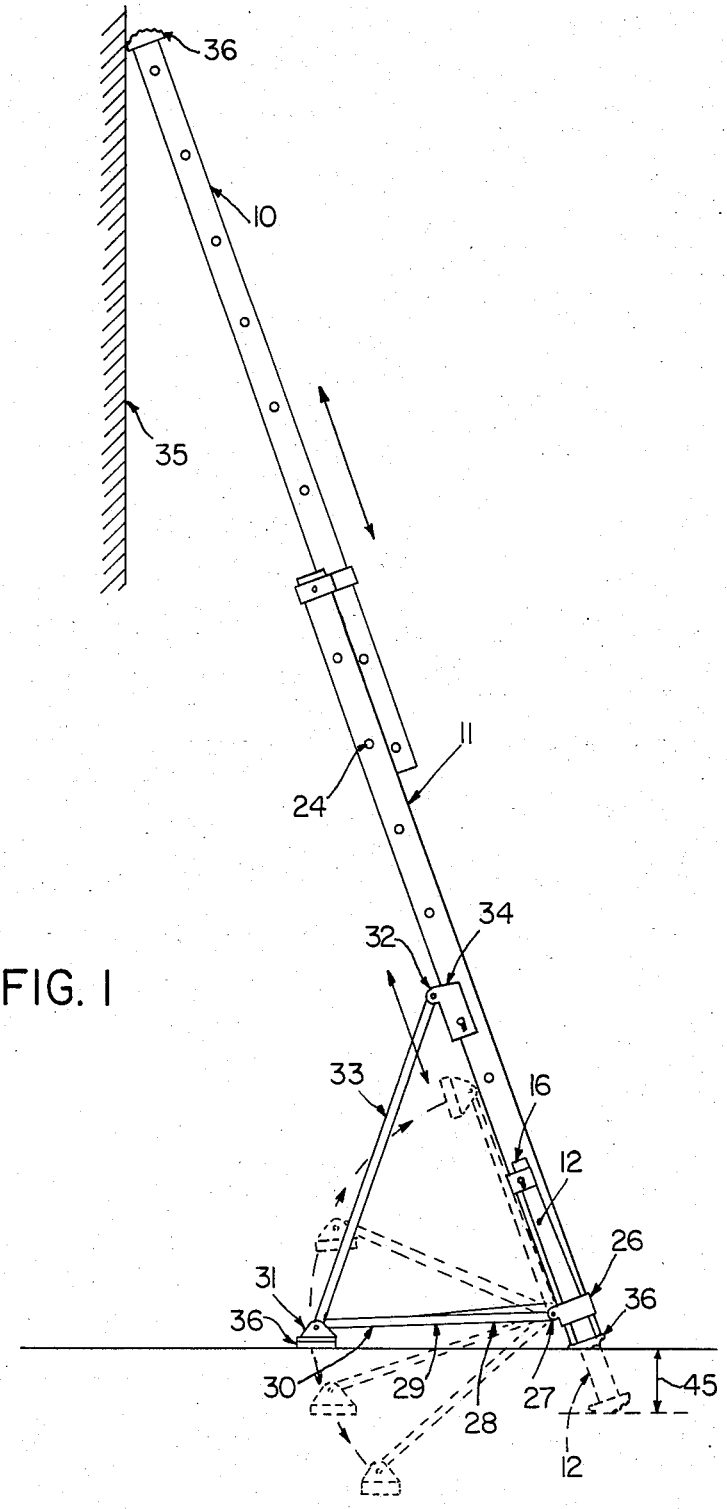
FIG. 1 is a side elevation of my invention indicating the range of movement and adjustment of the outriggers.
Figure 2:
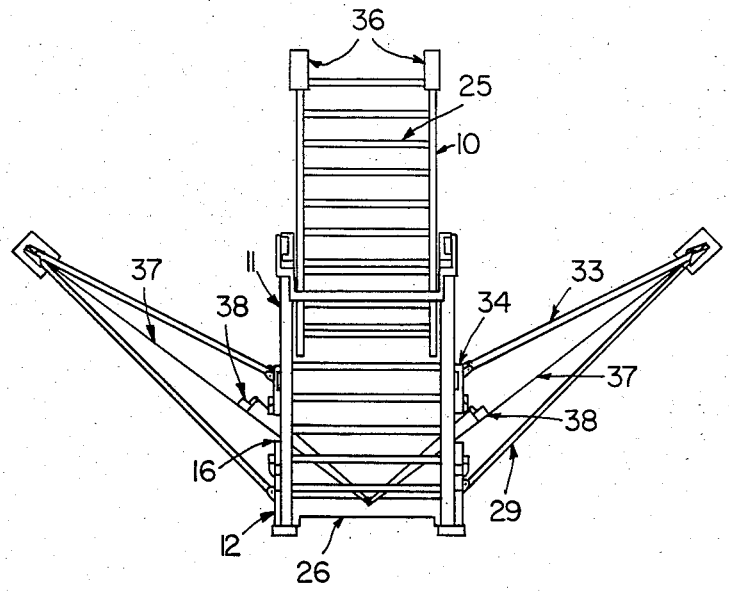
FIG. 2 is a plan view of the ladder the showing outrigger configuration when extended.
Figure 3:
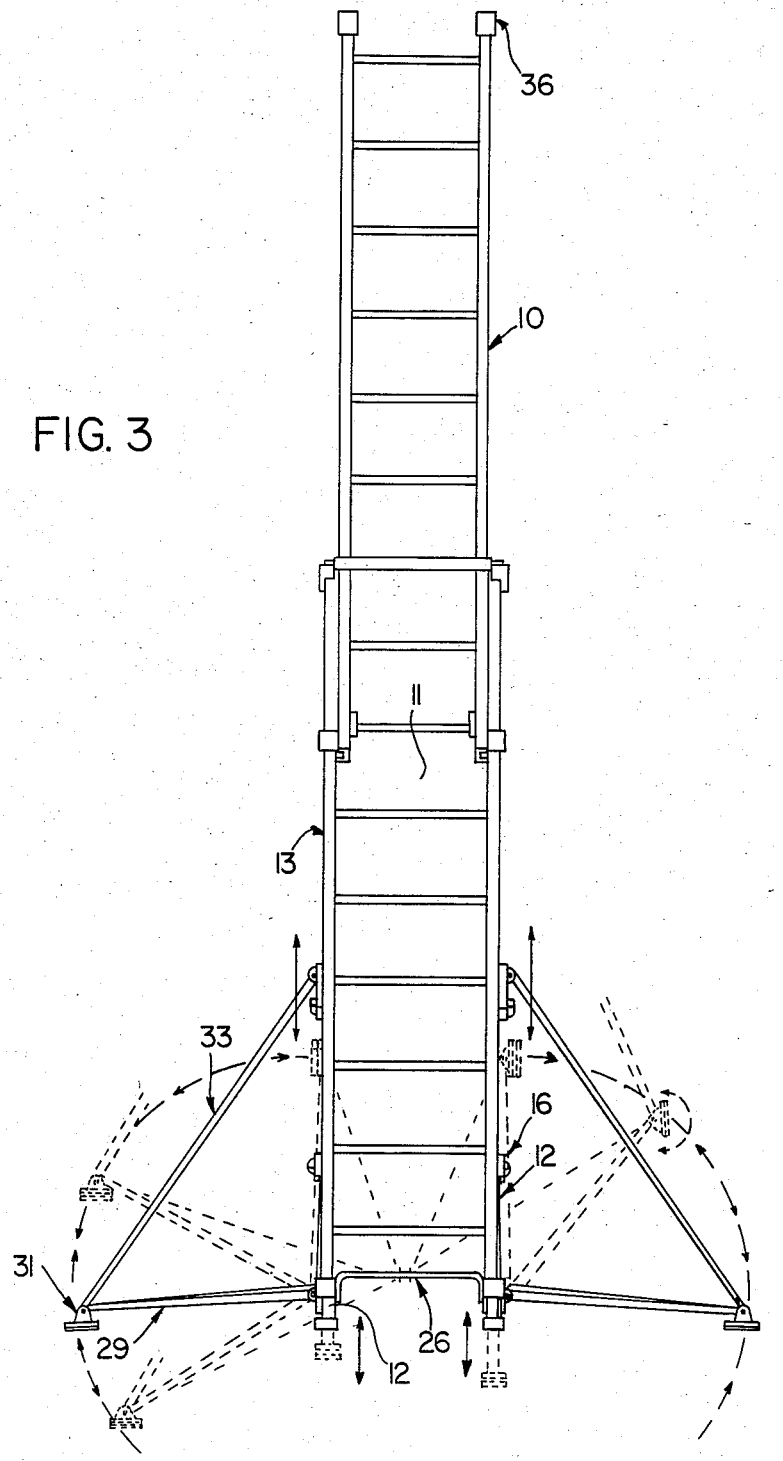
FIG. 3 is a front elevation of the ladder showing the range of adjustments of the outriggers, their independent actions, and also the adjustability of each stile leg.
Figure 4:
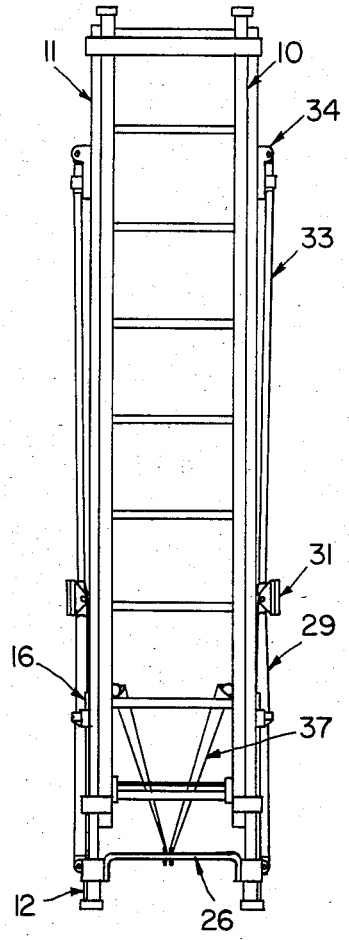
FIG. 4 is a front elevation of a ladder and outrigger system folded for transportation and/or storage.

An inherent advantage of my invention is that the outriggers may be folded up to lie closely adjacent to the stiles for storage and/or transportation purposes as best shown in FIG. 4.

Whilst a preferred embodiment of my invention has been described specifically in relation to aluminium ladders, it is to be appreciated that other types of ladders may include the invention as described in the accompanying claims. For example, glass-reinforced plastics (GRP) are being increasingly used, particularly in the electrical industry in view of their inherent non-conductivity. Appropriate stile profiles can be formed in this material, and one of the inherent weaknesses of each ladders, namely excessive flexibility, can be ameliorated by the use of the outriggers described and claimed herein.

The claims defining the invention are as follows:

I claim:

1. A safety ladder of extended length comprising two parallel stiles providing the sides of the ladder and which are liable to bow under load; spaced parallel rungs extending between the stiles; foldable outriggers associated with the lower end-portions of respective stiles; upper and lower hinged-together spars providing each of said outriggers; two pivots providing parallel horizontal pivotal axes connecting the free ends of the upper and lower spars of each outrigger respectively to upper and lower connections provided on the associated stiles, said pivots constraining movement of the associated outrigger to a single vertical plane which makes an acute angle with the plane containing the stiles while allowing the outrigger to be moved from a folded position at which it lies against the associated stile to an operating position at which it extends forwardly from the plane of the stiles to provide an additional ground support for the ladder; a clamp on said upper connection releasable to allow the connection to be slid to different positions along the stile when the outrigger is being moved between its two positions and tightenable to clamp the connection to the stile at any chosen position; and an adjustable flexible but inextensible stabilizing connection extending from the outer end of each outrigger to a position displaced from the associated stile and at the lower end of the ladder to prevent "walking" movement of the lower end of the stiles of the ladder away from the wall when a workman is ascending the ladder.

2. A ladder as set forth in claim 1, in which the upper connection comprises two parts presenting opposed flat clamping surfaces to opposite faces of a longitudinally extending web of the associated stile, and manually operable, eccentric, clamping member movable between two positions at one of which it separates the parts from the web to allow the upper connection to slide along the stile, and at the second of which the two parts clamp against opposite faces of the web to clamp the connection in a chosen position thereon.

3. A ladder as set forth in claim 2, in which the lower connections are provided on opposite sides of a frame fixed to the lower end of the ladder stiles and the flexible stabilizer comprises a cable having a pulley and a quick release jamming device and connected to the frame.

4. A ladder as set forth in claim 3, in which the frame includes respective sleeves through which the lower ends of respective stiles pass, and stile-extension legs incorporated in the lower ends of the stiles are guided by their passage through respective sleeves and are positionally controlled by the engagement of a pawl and ratchet mechanism attached to the stile.

* * * * *